US011730337B2

(12) United States Patent
Thompson-Simpkins et al.

(10) Patent No.: US 11,730,337 B2
(45) Date of Patent: Aug. 22, 2023

(54) MULTI-PURPOSE CLEANING TOOL

(71) Applicants: Crystal Thompson-Simpkins, Grand Rapids, OH (US); Luz Rios, Millbury, OH (US); David Frankforther, Perrysburg, OH (US)

(72) Inventors: Crystal Thompson-Simpkins, Grand Rapids, OH (US); Luz Rios, Millbury, OH (US); David Frankforther, Perrysburg, OH (US)

( * ) Notice: Subject to any disclaimer, the term of this patent is extended or adjusted under 35 U.S.C. 154(b) by 0 days.

(21) Appl. No.: 17/541,612

(22) Filed: Dec. 3, 2021

(65) Prior Publication Data

US 2022/0175211 A1 Jun. 9, 2022

Related U.S. Application Data

(60) Provisional application No. 63/121,551, filed on Dec. 4, 2020.

(51) Int. Cl.

| | |
|---|---|
| ***A47L 13/256*** | (2006.01) |
| ***A47L 13/42*** | (2006.01) |
| ***A47L 13/16*** | (2006.01) |

(52) U.S. Cl.

CPC ..... *A47L 13/256* (2013.01); *A47L 13/16* (2013.01); *A47L 13/42* (2013.01)

(58) Field of Classification Search

CPC ..... A47L 13/16; A47L 13/254; A47L 13/256; A47L 13/258; A47L 13/42; A47L 13/44

USPC ..... 15/231

See application file for complete search history.

(56) References Cited

U.S. PATENT DOCUMENTS

| | | | | |
|---|---|---|---|---|
| 3,106,736 | A * | 10/1963 | Knapp | A47L 13/146 15/119.2 |
| 5,970,633 | A * | 10/1999 | Jones | A43B 5/18 36/137 |
| 8,707,499 | B2 * | 4/2014 | Clark | B08B 1/00 15/105 |
| 11,304,583 | B2 * | 4/2022 | Whittington | A47L 13/254 |
| 2009/0158544 | A1 * | 6/2009 | Pagani | A47L 13/258 15/228 |
| 2014/0007906 | A1 * | 1/2014 | Bates | A47L 13/24 134/6 |

OTHER PUBLICATIONS

3M™ Doodlebug™ Floor Edge Cleaning Kit, https://www.3m.com/3M/en_US/p/d/b00043593/#:~:text=The%203M%E2%84%A2%20Doodlebug%E2%84%A2%20White%20Cleansing%20Pad%208440%20buffs,and%20wax%20from%20hard%20floor%20surfaces%20and%20baseboards.

3M Doodlebug Introductory Kit, https://www.amazon.com/3M-Doodlebug-Intro-Floor-System/dp/B005AWYCN4.

(Continued)

*Primary Examiner* — Laura C Guidotti
*Assistant Examiner* — Sidney D Hohl
(74) *Attorney, Agent, or Firm* — MacMillan, Sobanski & Todd, LLC

(57) ABSTRACT

A multi-purpose cleaning tool includes a frame having a first plate pivotally attached to a second plate. A biasing member is mounted between the first and second plates and urges the first plate and the second plate into a first position wherein the first plate and the second plate are co-planar. The frame is movable between the first position and a second position wherein the first and second plates are positioned at about a 90 degree angle from each other.

16 Claims, 5 Drawing Sheets

(56) References Cited

OTHER PUBLICATIONS

Genuine Joe Cleaning Pad Holder, https://www.amazon.com/Genuine-Joe-Cleaning-Holder-27000/dp/B00YE3EK0A/ref=pd_sbs_1/135-0691496-4099736?od rd w=NhF7m&pf_rd_p=690958f6-2825-419e-9c16-73ffd4055b65&pf_rd_r=39QQA25RYE4E8A4H9HGQ&pd_rd_r=1bd16878-7347-42a9-9ba4-8389c56fa58f&pd_rd_wg=werQW&pd_rd_i=B00YE3EK0A&psc=1.
How to Use a Doodle® Scrub by Square Scrub, https://video.search.yahoo.com/search/video?fr-mcafee&ei-UTF-8&p-doodle+bug+floor+-cleaner&type=E211US105G0#id=6&vid=c33362a60551d44f14c07df9e7093353&action=click.
Cleaning Hard to Reach Areas with the 3M™ Doodlebug Floor Edge Cleaning System, https://www.youtube.com/watch?v=j_kovpnYQVo.
Baseboard Buddy, https://www.amazon.com/Baseboard-Buddy-Clean-Baseboards-Moldings/dp/B01C6X37Q2.

* cited by examiner

MULTI-PURPOSE CLEANING TOOL

BACKGROUND OF THE INVENTION

This invention relates in general to cleaning tools. In particular, this invention relates to an improved multi-purpose cleaning tool configured to simultaneously clean two adjacent surfaces such as a baseboard and an adjoining floor, a wall and an adjoining floor, or a wall and an adjoining ceiling.

One known cleaning tool is the commercially available Baseboard Buddy. The Baseboard Buddy is however designed and structured to only clean baseboards.

Thus, it would be desirable to provide an improved multi-purpose cleaning tool that allows the user to easily, efficiently, and simultaneously clean two adjacent surfaces such as a baseboard and an adjoining floor, a wall and an adjoining floor, or a wall and an adjoining ceiling.

SUMMARY OF THE INVENTION

This invention relates to an improved multi-purpose cleaning tool configured to simultaneously clean two adjacent surfaces such as a baseboard and an adjoining floor, a wall and an adjoining floor, or a wall and an adjoining ceiling.

One embodiment of the multi-purpose cleaning tool includes a frame having a first plate pivotally attached to a second plate. A biasing member is mounted between the first and second plates and urges the first plate and the second plate into a first position wherein the first plate and the second plate are co-planar. The frame is movable between the first position and a second position wherein the first and second plates are positioned at about a 90 degree angle from each other.

An additional embodiment of the multi-purpose cleaning tool includes a frame having a first plate pivotally attached to a second plate. A pair of torsion springs is mounted between the first and second plates and urges the first plate and the second plate into a first position wherein the first plate and the second plate are co-planar. The frame is movable between the first position and a second position wherein the first and second plates are positioned at about a 90 degree angle from each other, and a plurality of positions intermediate of the first position and the second position. The first and second plates include a plurality of weight-reducing holes formed therein.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
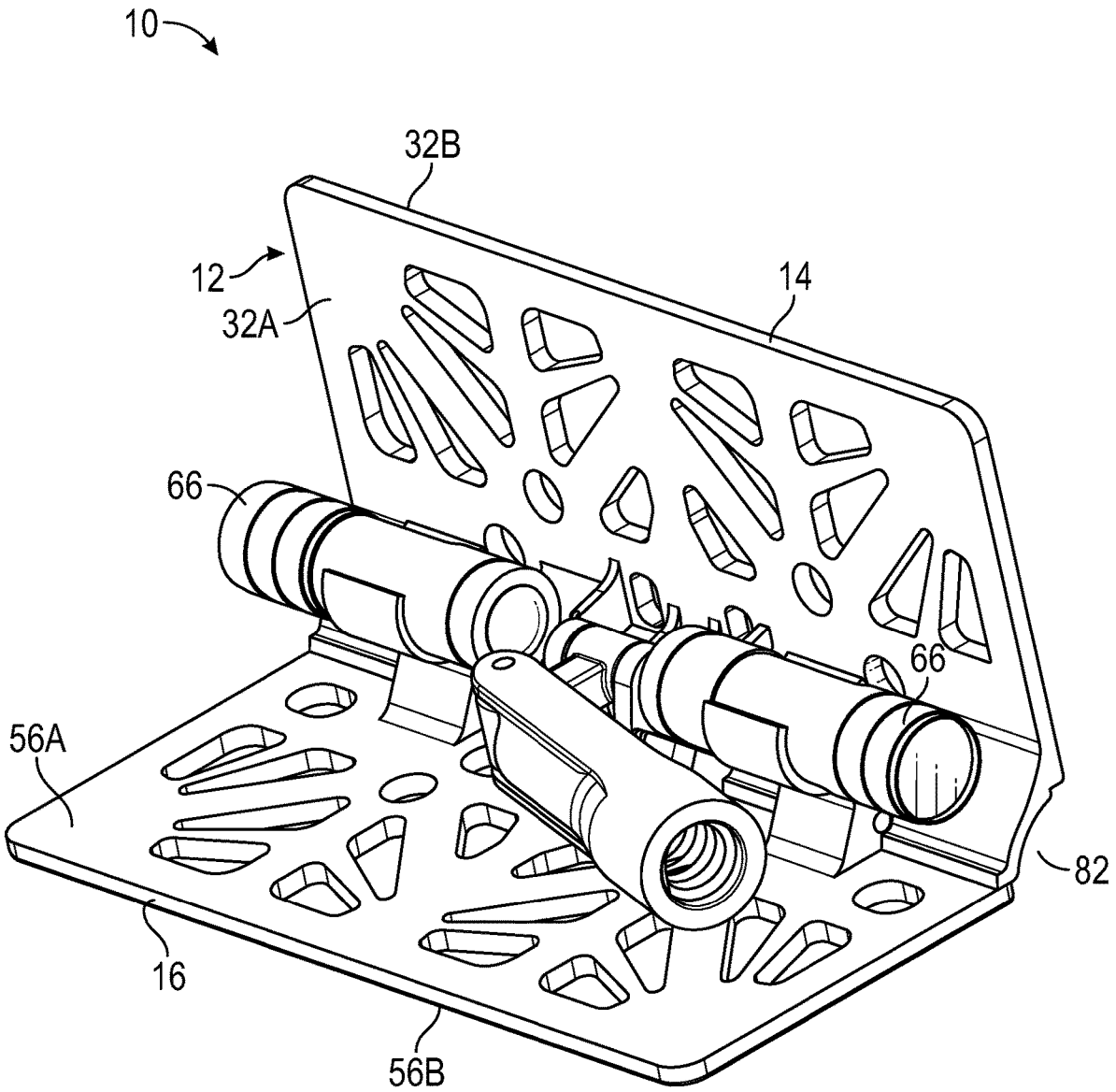
FIG. 1 is a perspective view of a first embodiment of the multi-purpose cleaning tool.

Referring now to the drawings, there is illustrated in FIGS. 1 through 4 a basic structure of a first embodiment of a multi-purpose cleaning tool 10 in accordance with this invention. The multi-purpose cleaning tool 10 includes a conventional elongated handle (not shown) removably attached to a first embodiment of a frame 12. The handle (not shown) may have any desired length and may be configured such that its length may be adjustable.

The frame 12 comprises a first plate 14 pivotally connected to a second plate 16 by a pin 18, and a knuckle 20 pivotally connected to the frame 12 and also pivotally connected to a head or handle attachment member 22.

The knuckle 20 includes a first end 24A configured for pivoting connection to the handle attachment member 22, and a second end 24B configured for pivoting connection to a pair of knuckle mounting flanges 26A and 26B, described in detail below. The handle attachment member 22 includes a threaded connection 28 for the handle (not shown) at a first end thereof, and a pair of knuckle attachment apertures 30 at a second end thereof. It will be understood that the knuckle 20 may be pivotally connected to the frame 12 and to the handle attachment member 22 by any desired means, including but not limited to a pin or a bolt (not shown).

The first plate 14 includes a first planar surface 32A (the upwardly facing surface when viewing FIG. 5) and a second planar surface or cleaning surface 32B. The first plate 14 includes a plurality of holes 34 formed therein to reduce the weight of the first plate 14. It will be understood that any number of holes 34 may be formed in the first plate 14 and that the first plate 14 may also have no holes formed therein.

Figure 2:
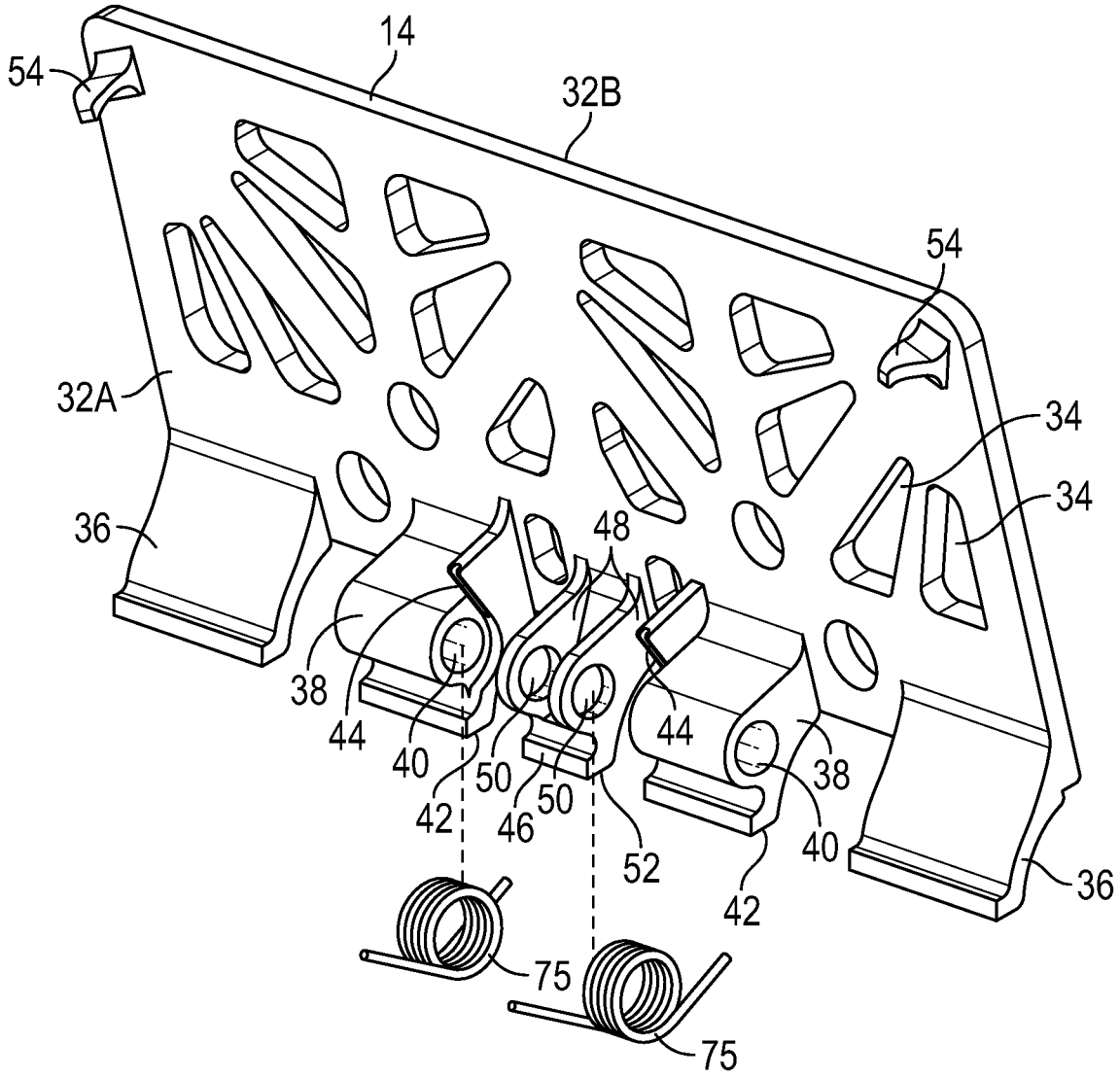
FIG. 2 is an exploded perspective view of the first plate of the multi-purpose cleaning tool shown in FIG. 1.
Figure 5:
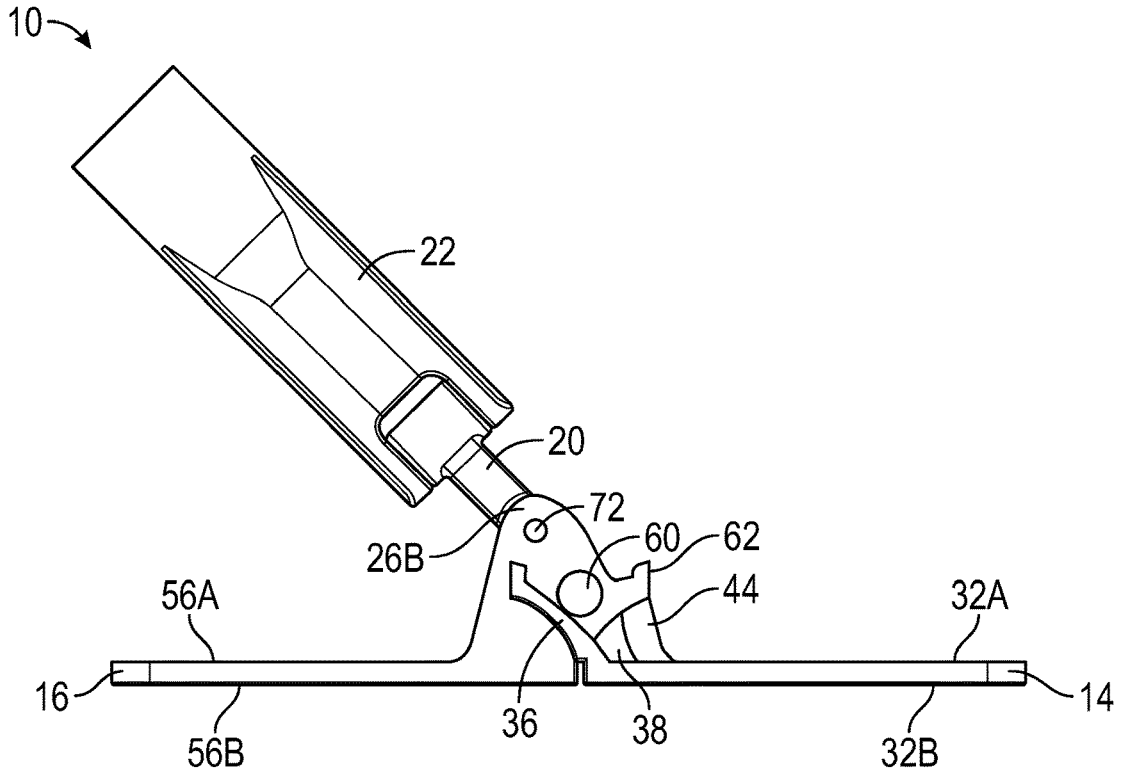
FIG. 5 is a side elevational view of the multi-purpose cleaning tool illustrated in FIGS. 1 through 4 shown in a first position.

The first planar surface 32A includes a pair of arcuate engagement stops or tabs 36 formed at longitudinally outboard ends of the first planar surface 32A and extending outwardly therefrom (leftward when viewing FIG. 2 and upwardly when viewing FIG. 5). A pair of first connecting members 38 are formed on the first planar surface 32A inboard of the arcuate engagement stops 36. The first connecting members 38 include a pin channel 40 formed therethrough, a stop surface 42 configured to engage the second plate 16, and a first spring mounting seat 44 formed on an inboard side thereof.

Figure 6:
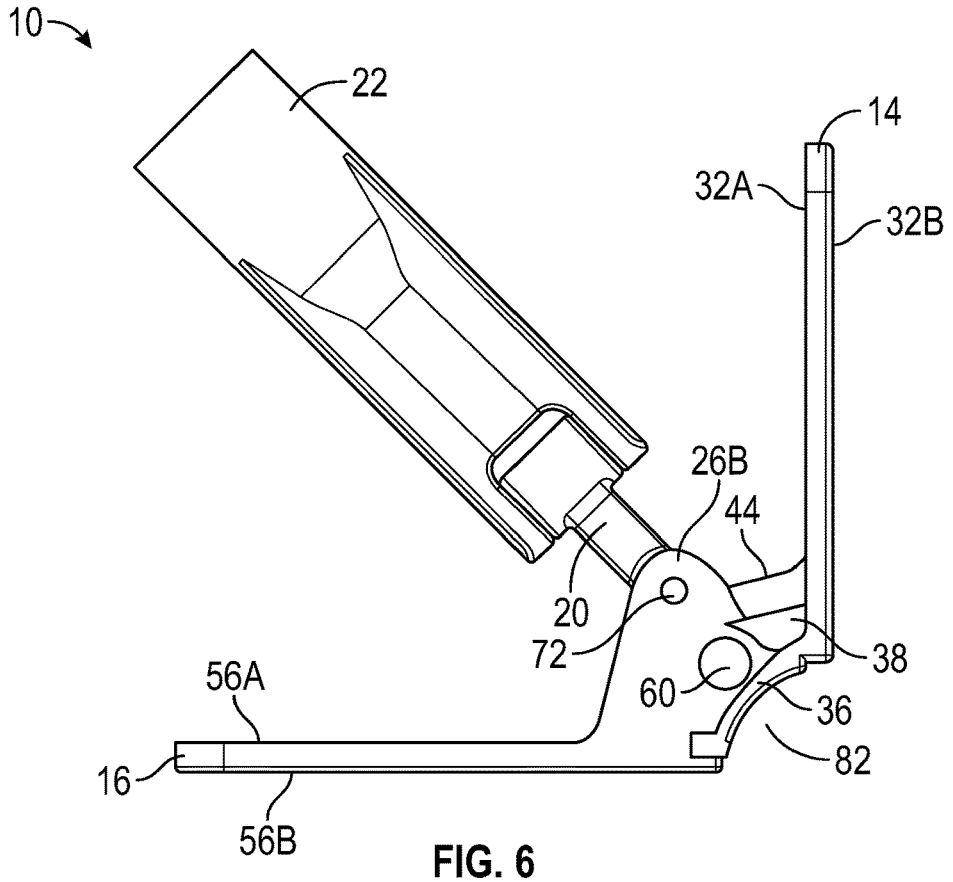
FIG. 6 is alternate side elevational view of the multi-purpose cleaning tool illustrated in FIGS. 1 through 5 and shown in a second position.

A second connecting member 46 is formed on the first planar surface 32A between the first connecting members 38. The second connecting member 46 includes a pair of flanges 48, each flange 48 having a pin channel 50 formed therethrough. A stop surface 52 is formed on the second connecting member 46 and is configured to engage the second plate 16. As best shown in FIG. 2, fabric attachment hooks 54 may be formed on the corners of the first plate 14 opposite the arcuate engagement stops 36. Alternatively, the first plate 14 may be formed without the fabric attachment hooks 54, as shown in FIGS. 1, 5, and 6.

The second plate 16 includes a first planar surface 56A (the upwardly facing surface when viewing FIG. 3) and a second planar surface or cleaning surface 56B. The second plate 16 includes the plurality of holes 34 formed therein to reduce the weight of the second plate 16. It will be understood that any number of holes 34 may be formed in the second plate 16 and that the second plate 16 may also have no holes formed therein.

The first planar surface 56A includes a pair of third connecting members 58 formed on the first planar surface 56A, and extending outwardly therefrom (upwardly when viewing FIG. 3), near the longitudinally outboard ends of the first planar surface 56A. The third connecting members 58 include a pin channel 60 formed therethrough, a stop surface 62 configured to engage the first plate 14, and an open, semi-cylindrical channel. The channel defines a light retention clip 64 configured to retain an illumination device such as a conventional small flashlight, such as shown at 66 in FIG. 1. Alternatively, the multi-purpose cleaning tool 10 may be formed without the light retention clip 64, such as shown in FIGS. 5 and 6.

The second plate 16 further includes the pair of knuckle mounting flanges 26A and 26B extending outwardly from the second plate 16 (upwardly when viewing FIG. 3) inboard of the third connecting members 58. Each knuckle mounting flange 26A and 26B includes a pin channel 68 formed therethrough, a stop surface 70 configured to engage the first plate 14, a knuckle mounting aperture 72 formed therethrough, and a second spring mounting seat 74 formed on an outboard side thereof. Although each knuckle mounting flange 26A and 26B is shown having only one knuckle mounting aperture 72 formed therethrough, if desired each knuckle mounting flange 26A and 26B may include more than one knuckle mounting aperture 72.

Torsion springs 75 are mounted between the first spring mounting seats 44 of the first connecting members 38 and the second spring mounting seats 74 of the knuckle mounting flanges 26A and 26B. The torsion springs 75, or other suitable biasing means, positioned and configured to urge the first and second plates 14 and 16, respectively, away from each other. If desired, the multi-purpose cleaning tool 10 may include only one torsion spring 75 or more than two torsion springs 75, or other suitable biasing means that may be mounted at any desired locations along the pin 18.

Figure 3:
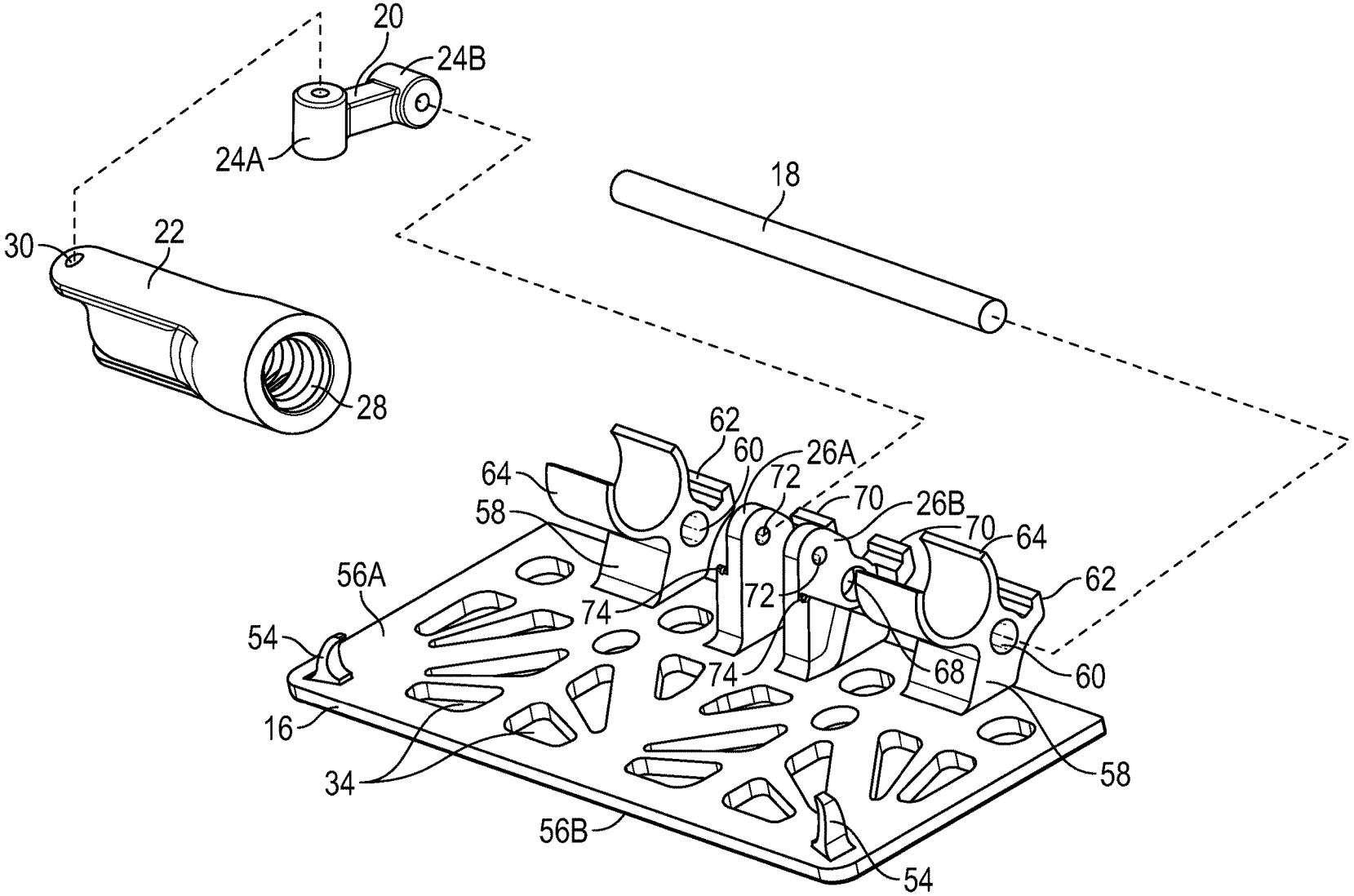
FIG. 3 is an exploded perspective view of the second plate of the multi-purpose cleaning tool shown in FIG. 1.

As best shown in FIG. 3, fabric attachment hooks 54 may be formed on the corners of the second plate 16 opposite the third connecting members 58. Alternatively, the second plate 16 may be formed without the fabric attachment hooks 54, as shown in FIG. 1.

Figure 4:
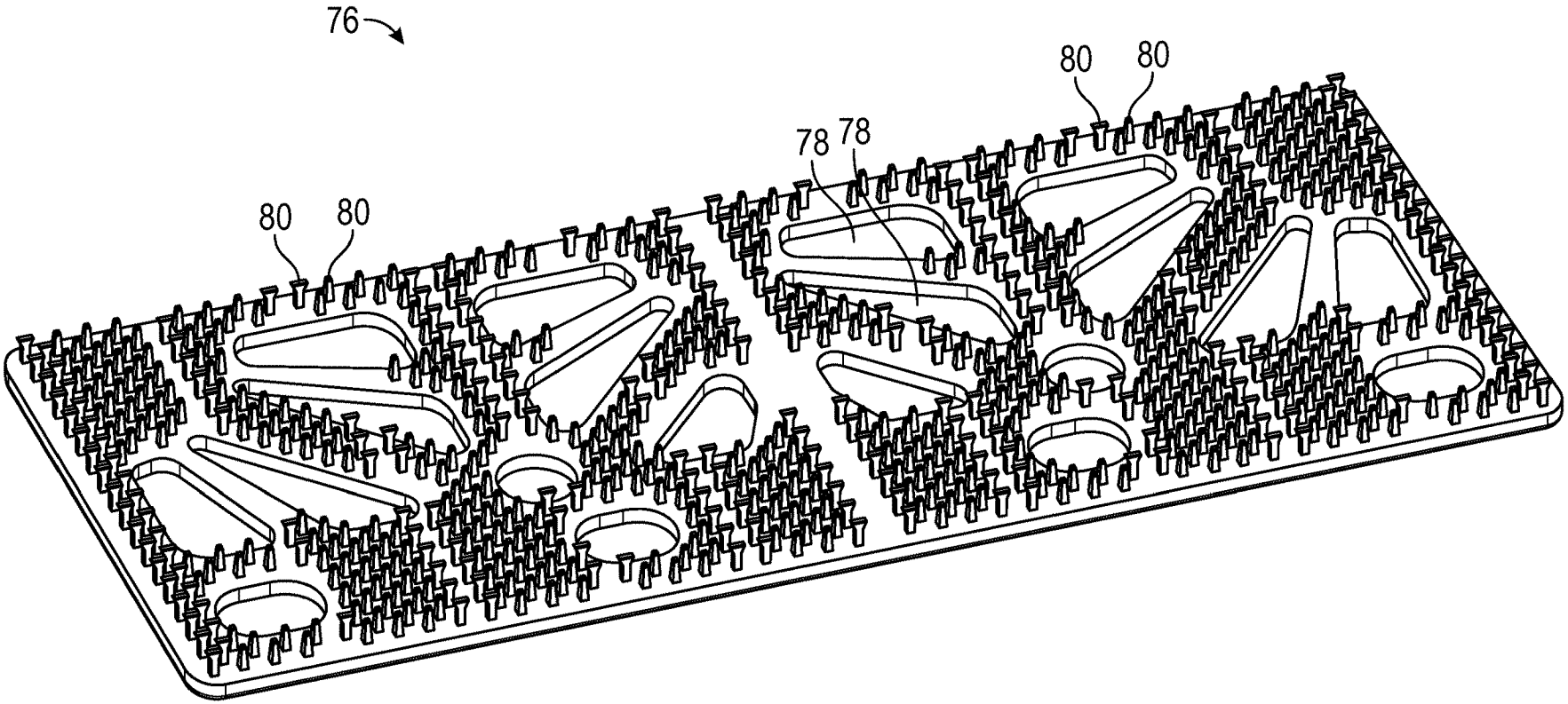
FIG. 4 is a perspective view of the cloth attachment plate for use with the multi-purpose cleaning tool shown in FIGS. 1 through 3.

Referring now to FIG. 4, a cloth attachment plate is shown at 76 and has holes 78 corresponding to the holes 34 formed in the first and second plates 14 and 16, respectively. One surface (the upwardly facing surface when viewing FIG. 4) includes a plurality of small hooks 80 extending outwardly therefrom. The plurality of small hooks 80 are similar to the hooks in a hook and loop attachment system and are configured for the attachment thereto of any of a desired conventional cleaning cloth or cleaning material (not shown).

The cloth attachment plate 76 shown in FIG. 4 is configured to be removably attached, i.e., selectively attached and reattached as needed, to the second planar surface 32B of the first plate 14 and the second planar surface 56B of the second plate 16. Alternatively, the second planar surfaces 32B and 56B may be formed with the plurality of the small hooks 80 formed thereon.

The first and second plates 14 and 16, respectively, the cloth attachment plate 76, and any of the components of the various embodiments of the multi-purpose cleaning tool 10 disclosed herein may be formed from any desired material including, but not limited to, plastic, metal, composites, and combinations thereof.

It will be understood that the planar surfaces 32B and 56B may include attachment means for the attachment any conventional cleaning pad or like structure, and may be otherwise configured for the attachment of such conventional cleaning pads or like structures.

The frame 12 of the multi-purpose cleaning tool 10 may be moved between the first position as shown in FIG. 5, wherein the first and second plates 14 and 16 are substantially co-planar, a second position as shown in FIGS. 1 and 6, wherein the first and second plates 14 and 16 are positioned at about a 90 degree angle from each other, and a plurality positions intermediate to the first and second positions (not shown). Alternatively, the first and second plates 14 and 16 may be oriented as an angle less than 90 degrees.

A locking device (not shown), such as a mechanical locking device, may be provided between the first and second plates 14 and 16 and configured to releasably retain the first and second plates 14 and 16 in any desired position relative to each other, such as in any of the first, second, or intermediate positions. For example, a pin (not shown) may be movably mounted between the first and second plates 14 and 16 and configured to releasably retain the first and second plates 14 and 16 in the second position, i.e., at about a 90 degree angle.

The force of the torsion springs 75 maintains the first and second plates 14 and 16 in the first position. To move the frame 12 between the first and second positions, a user must only apply a force to one or both of the first and second plates 14 and 16, such as by urging the first plate 14 against a floor and the second plate 16 against an adjacent wall or baseboard.

In the second position, as best shown in FIGS. 1 and 6, the arcuate engagement stops 36, third connecting members 58, first connecting members 38, knuckle mounting flanges 26A and 26B, and second connecting member 46 collectively define a space or gap 82 for a structure such as a base board quarter-round when the multi-purpose cleaning tool 10 is in use.

Advantageously, the multi-purpose cleaning tool 10 is relatively light weight, durable, easily moved between the first, flat position (see FIG. 5), the second, 90 degree position (see FIGS. 1 and 6), and the plurality of intermediate positions, and may be configured such that a variety of different cleaning cloths and other fabric material may be attached thereto. Additionally, the multi-purpose cleaning tool 10 is more durable than known cleaning tools such that it may be used effectively and efficiently in commercial settings as well as in residential settings.

Further, because the multi-purpose cleaning tool 10 is configured to simultaneously clean two adjacent surfaces such as a baseboard and an adjoining floor, a wall and an adjoining floor, or a wall and an adjoining ceiling with the removably attached, conventional elongated handle (not shown) described above, the user may clean without the physical stress of frequently bending over. The multi-purpose cleaning tool 10 with its attached handle also allows the user to engage in less rigorous cleaning than is required when using known cleaning tools, and allows the user to easily access more difficult to reach spaces.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A multi-purpose cleaning tool comprising:

a frame having a first plate pivotally attached to a second plate; and a biasing member between the first and second plates, the biasing member urging the first plate and the second plate into a first position wherein the first plate and the second plate are co-planar;

wherein the frame is movable between the first position and a second position wherein the first and second plates are positioned at about a 90 degree angle from each other;

wherein the first plate includes a first planar surface, the first planar surface having:

a pair of arcuate engagement stops formed at longitudinally outboard ends thereof and extending outwardly therefrom;

a pair of first connecting members formed thereon inboard of the arcuate engagement stops, the first connecting members having a pin channel formed therethrough, a stop surface configured to engage the second plate, and a first spring mounting seat formed on an inboard side thereof; and a second connecting member formed thereon between the first connecting members, the second connecting member having a pair of flanges, each flange having a pin channel formed therethrough, and a stop surface formed thereon configured to engage the second plate; and wherein the second plate includes a first planar surface, the first planar surface having:

a pair of third connecting members formed thereon, and extending outwardly therefrom, the third connecting members having a pin channel formed therethrough, a stop surface configured to engage the first plate, and an open, semi-cylindrical channel that defines a light retention clip configured to retain an illumination device;

a pair of knuckle mounting flanges extending outwardly therefrom inboard of the third connecting members, each knuckle mounting flange having a pin channel formed therethrough, a stop surface configured to engage the first plate, a knuckle mounting aperture formed therethrough, and a second spring mounting seat formed on an outboard side thereof;

wherein the biasing member is a pair of torsion springs; and wherein the torsion springs are mounted between the first spring mounting seats of the first connecting members and the second spring mounting seats of the knuckle mounting flanges, the torsion springs positioned and configured to urge the first and second plates away from each other.

2. The multi-purpose cleaning tool according to claim 1, wherein the frame is movable between a plurality of positions intermediate of the first position and the second position.

3. The multi-purpose cleaning tool according to claim 1, further including a cloth attachment plate removably attached to a cleaning surface of the first plate, wherein the cloth attachment plate includes a plurality of hooks extending outwardly therefrom, and wherein the hooks are configured for the attachment thereto of any of a cleaning cloth and cleaning material.

4. The multi-purpose cleaning tool according to claim 3, further including a cloth attachment plate removably attached to a cleaning surface of the second plate, wherein the cloth attachment plate includes a plurality of hooks extending outwardly therefrom, and wherein the hooks are configured for the attachment thereto of any of a cleaning cloth and cleaning material.

5. The multi-purpose cleaning tool according to claim 1, further including a cloth attachment plate removably attached to a cleaning surface of the second plate, wherein the cloth attachment plate includes a plurality of hooks extending outwardly therefrom, and wherein the hooks are configured for the attachment thereto of any of a cleaning cloth and cleaning material.

6. The multi-purpose cleaning tool according to claim 1, wherein the first plate includes a plurality of hooks extending outwardly therefrom, and wherein the hooks are configured for the attachment thereto of any of a cleaning cloth and cleaning material.

7. The multi-purpose cleaning tool according to claim 6, wherein the second plate includes a plurality of hooks extending outwardly therefrom, and wherein the hooks are configured for the attachment thereto of any of a cleaning cloth and cleaning material.

8. The multi-purpose cleaning tool according to claim 1, wherein the second plate includes a plurality of hooks extending outwardly therefrom, and wherein the hooks are configured for the attachment thereto of any of a cleaning cloth and cleaning material.

9. The multi-purpose cleaning tool according to claim 1, further including fabric attachment hooks formed on the first and second plates.

10. The multi-purpose cleaning tool according to claim 1, wherein the illumination device is a flashlight.

11. The multi-purpose cleaning tool according to claim 1, wherein the first and second plates include a plurality of weight-reducing holes formed therein.

12. The multi-purpose cleaning tool according to claim 1, further including a cloth attachment plate removably attached to a cleaning surface of the first plate, and a cloth attachment plate removably attached to a cleaning surface of the second plate, wherein the cloth attachment plates include a plurality of hooks extending outwardly therefrom, and wherein the hooks are configured for the attachment thereto of any of a cleaning cloth and cleaning material.

13. The multi-purpose cleaning tool according to claim 1, wherein the first plate includes a plurality of hooks extending outwardly therefrom, wherein the second plate includes a plurality of hooks extending outwardly therefrom, and wherein the hooks are configured for the attachment thereto of any of a cleaning cloth and cleaning material.

14. A multi-purpose cleaning tool comprising:

a frame having a first plate pivotally attached to a second plate; and a pair of torsion springs between the first and second plates, the pair of torsion springs urging the first plate and the second plate into a first position wherein the first plate and the second plate are co-planar;

wherein the frame is movable between the first position and a second position wherein the first and second plates are positioned at about a 90 degree angle from each other;

wherein the frame is movable between a plurality of positions intermediate of the first position and the second position;

wherein the first and second plates include a plurality of weight-reducing holes formed therein;

wherein the first plate includes a first planar surface, the first planar surface having a pair of arcuate engagement stops formed at longitudinally outboard ends thereof and extending outwardly therefrom, a pair of first connecting members formed thereon inboard of the arcuate engagement stops, the first connecting members having a pin channel formed therethrough, a stop surface configured to engage the second plate, and a first spring mounting seat formed on an inboard side thereof, and a second connecting member formed thereon between the first connecting members, the second connecting member having a pair of flanges, each flange having a pin channel formed therethrough, and a stop surface formed thereon configured to engage the second plate;

wherein the second plate includes a first planar surface, the first planar surface having a pair of third connecting members formed thereon, and extending outwardly therefrom, the third connecting members having a pin channel formed therethrough, a stop surface configured to engage the first plate, and an open, semi-cylindrical channel that defines a light retention clip configured to retain an illumination device, a pair of knuckle mounting flanges extending outwardly therefrom inboard of the third connecting members, each knuckle mounting flange having a pin channel formed therethrough, a stop surface configured to engage the first plate, a knuckle mounting aperture formed therethrough, and a second spring mounting seat formed on an outboard side thereof; and wherein the torsion springs are mounted between the first spring mounting seats of the first connecting members and the second spring mounting seats of the knuckle mounting flanges, the torsion springs positioned and configured to urge the first and second plates away from each other.

15. A multi-purpose cleaning tool comprising:

a frame having a first plate pivotally attached to a second plate; and a biasing member between the first and second plates, the biasing member urging the first plate and the second plate into a first position wherein the first plate and the second plate are co-planar;

wherein the first plate includes a first planar surface and a second planar surface, the second planar surface defining a cleaning surface;

wherein the first plate includes a plurality of arcuate engagement stops formed at longitudinally outboard ends of the first planar surface and extending outwardly therefrom and a plurality of first connecting members formed thereon inboard of the arcuate engagement stops, the first connecting members having a pin channel formed therethrough, a stop surface configured to engage the second plate, and a first spring mounting seat formed on an inboard side thereof; and a second connecting member formed thereon between the first connecting members, the second connecting member having a pair of flanges, each flange having a pin channel formed therethrough, and a stop surface formed thereon configured to engage the second plate;

wherein the second plate includes a first planar surface and a second planar surface, the second planar surface defining a cleaning surface;

wherein the second plate includes a plurality of third connecting members formed on the first planar surface, and extending outwardly therefrom, the third connecting members having a pin channel formed therethrough, a stop surface configured to engage the first plate, and an open semi-cylindrical channel that defines a light retention clip configured to retain an illumination device;

a plurality of knuckle mounting flanges extending outwardly therefrom inboard of the third connecting members, each of the knuckle mounting having a pin channel formed therethrough, a stop surface configured to engage the first plate, a knuckle mounting aperture formed therethrough, and a second spring mounting seat formed on an outboard side thereof;

wherein the biasing member is a pair of torsion springs; and wherein the torsion springs are mounted between the first spring mounting seats of the first connecting members and the second spring mounting seats of the knuckle mounting flanges;

wherein the frame is movable between the first position and a second position wherein the first and second plates are positioned at about a 90 degree angle from each other; and wherein when the frame is in the second position, the plurality of arcuate engagement stops and the plurality of first connecting members of the first plate, and the plurality of knuckle mounting flanges and the plurality of third connecting members of the second plate combine to define an arcuate frame cleaning surface for a structure.

16. The multi-purpose cleaning tool according to claim 15, wherein the structure is a base board quarter-round.

* * * * *